US005931388A

United States Patent [19]

Loebenfelder et al.

[11] Patent Number: 5,931,388

[45] Date of Patent: Aug. 3, 1999

[54] FUEL INJECTION VALVE FOR INTERNAL COMBUSTION ENGINES

[75] Inventors: Guenter Loebenfelder; Gerhard Bauer, both of Bamberg; Bernd Kailing, Baunach; Manfred Mack, Altheim; Oliver Brygier, Zeil, all of Germany

[73] Assignee: Robert Bosch GmbH, Stuttgart, Germany

[21] Appl. No.: 08/882,210

[22] Filed: Jun. 25, 1997

[30] Foreign Application Priority Data

Jul. 3, 1996 [DE] Germany ..... 196 26 663

[51] Int. Cl.[6] ..... F02M 59/00

[52] U.S. Cl. ..... 239/533.2; 239/533.8; 239/533.9; 239/533.15

[58] Field of Search ..... 239/533.1, 533.2, 239/533.3, 533.8, 533.9, 533.15, 583, 584

[56] References Cited

U.S. PATENT DOCUMENTS

| | | | |
|---|---|---|---|
| 3,081,952 | 3/1963 | Woodward et al. | 239/533.2 |
| 4,852,808 | 8/1989 | Yamamoto | 239/533.8 |
| 4,917,307 | 4/1990 | Baxter et al. | 239/533.2 |
| 5,209,403 | 5/1993 | Tarr et al. | 239/533.8 |
| 5,673,670 | 10/1997 | Powell et al. | 123/463 |

FOREIGN PATENT DOCUMENTS 0 400 886 2/1991 European Pat. Off. .

*Primary Examiner*—Andres Kashnikow
*Assistant Examiner*—Lisa Ann Douglas
*Attorney, Agent, or Firm*—Edwin E. Greigg; Ronald E. Greigg

[57] ABSTRACT

A fuel injection valve for internal combustion engines, having a valve member guided axially displaceably in a bore of a valve body. On an end of the valve member toward the combustion chamber, a valve sealing face is disposed, with which the valve member cooperates with a valve seat face on the valve body to control an injection cross section. At least one valve spring that acts upon the valve member and is inserted into a spring chamber is provided in a valve retaining body that is braced axially against the valve body. The spring chamber is closed on one end remote from the combustion chamber by a lid. The lid is secured to the valve retaining body by a crimped connection.

7 Claims, 1 Drawing Sheet

FUEL INJECTION VALVE FOR INTERNAL COMBUSTION ENGINES

BACKGROUND OF THE INVENTION

The invention is based on a fuel injection valve for internal combustion engines.

In one such fuel injection valve, known from European Patent Disclosure EP 0 400 886 A1, a pistonlike valve member is guided axially displaceably in a bore of a valve body. The valve member, on its end toward the combustion chamber, has a valve sealing face, with which it cooperates with a stationary valve seat face on the valve body. A high-pressure fuel conduit, which is connected to an injection line of an injection pump and is acted upon thereby with high fuel pressure in alternation, discharges at the valve seat. Downstream, the valve seat face is adjoined by at least one injection opening into the combustion chamber of the engine to be supplied. During the intervals between injections, the valve member keeps the communication between the high-pressure conduit and the injection opening closed by means of the contact of the sealing face of the valve member with the valve seat. If an injection is to take place, then the valve member is lifted from the valve seat by the high fuel pressure, and a flow cross section to the injection openings is opened between the sealing face and the valve seat face.

The valve member is urged in the closing direction by a restoring force, which in the known fuel injection valve is generated by two valve springs in line axially with one another, of which a first valve spring acts upon the valve member constantly, and a second valve spring does not engage the valve member until after a certain opening stroke motion.

The valve springs are disposed in a spring chamber that is formed in a valve retaining body which in turn is axially braced against the valve body. The spring chamber in the known fuel injection valve is closed, on its end remote from the combustion chamber and from the valve body, by a lid that is secured to the valve body by means of an adjustable spring stop that is screwed into the spring chamber.

The known fuel injection valve has the disadvantage, however, that securing the lid to the valve body entails major production and assembly effort and expense.

OBJECT AND SUMMARY OF THE INVENTION

The fuel injection valve for internal combustion engines for the invention has the advantage over the prior art that from a production standpoint the lid that closes the spring chamber is simple to secure to the valve retaining body by means of a crimped connection. In this way, it is possible to dispense with a complicated thread on the valve retaining body and the lid. In addition, the lid can be embodied as an easily produced deep-drawn part that requires no expensive metal-cutting machining.

The operation of joining the lid to the valve retaining body is advantageously accomplished by means of a drawing ring, which is guided over the lid and in the process engages a radially protruding annular bead on the open face end of the lid and presses this wall region of the lid, over its entire circumference, into an annular groove on the valve retaining body. This way of securing the lid has the advantage that forces need to be introduced into the fuel injection valve only in the axial direction. To fasten the valve retaining body, a stationary counterpart stop face thus suffices, on which the valve retaining body rests with an annular shoulder on its circumferential face. To prevent canting of the drawing ring, the cross-sectional transitional faces between the annular bead and the jacket face of the lid, and on the cross-sectional restriction in the drawing ring, are embodied as chamfered. Advantageously, the drawing ring serving as a deforming tool is also made of a harder material, such as steel, than the lid, which is preferably made of sheet metal.

For securely sealing off the spring chamber from the outside, a sealing ring is also fastened between the valve retaining body and the lid; it is preferably disposed between the end face of the valve retaining body and an offset, closed annular end face of the lid.

By indenting the open lid edge into the annular groove of the valve retaining body, a stable axial bracing and securing of the lid on the valve retaining body is thus attained in a manner that is simple from a production standpoint, so that the valve spring on the top can be supported directly on the closed lid wall. Adjusting the spring prestressing force is done via adjusting shims placed between the upper valve spring and the closed lid wall.

The lid fastening according to the invention is shown in a fuel injection valve with a so-called two-spring holder, but it can also be used in injection valves of other designs.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
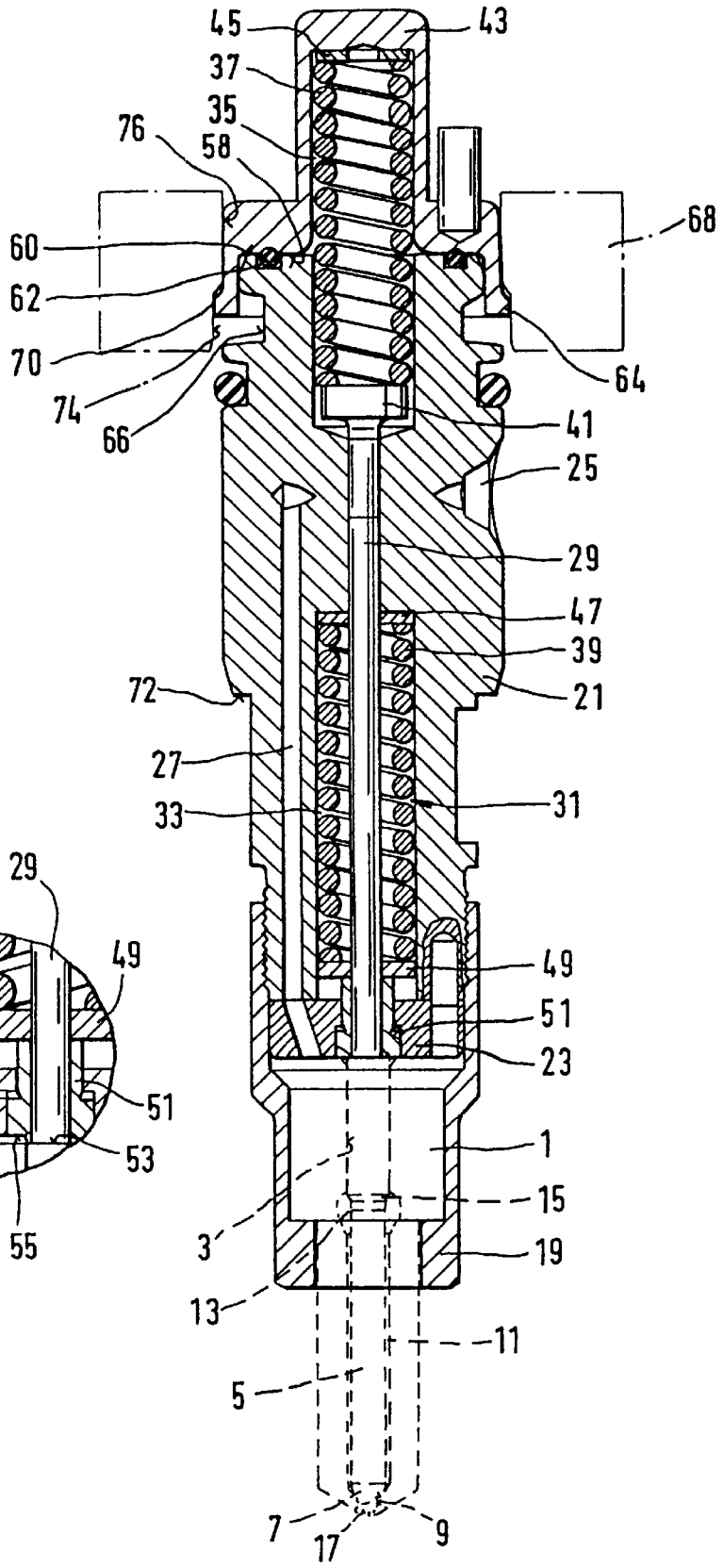
FIG. 1 is a section through the upper portion of the fuel injection valve, remote from the combustion chamber.

The fuel injection valve for internal combustion engines shown in FIG. 1 has a valve body 1, which protrudes by its lower end into a combustion chamber of a internal combustion engine not shown. An axial bore 3 is provided in the valve body 1; a pistonlike valve member 5 is guided axially displaceably in this bore and on its lower end face has a conical valve sealing face 7, with which it cooperates with a conical valve seat face 9 on the closed end of the bore 3 in the valve body 1. A high-pressure fuel conduit 11 that discharges at the valve seat face 9 is formed by the annular gap between the valve member 5 and the wall of the bore 3 and widens via a cross-sectional enlargement to form a pressure chamber 13. In the region of the pressure chamber 13, the valve member 5 has an annular shoulder 15, by way of which the pressure prevailing in the pressure chamber 13 can urge the valve member 5 in the opening direction.

Downstream of the valve seat 9, this seat is adjoined by at least one injection opening 17, which beginning at the bore 3 discharges into the combustion chamber of the engine to be supplied.

The valve body 1, on its end remote from the combustion chamber, is axially braced by means of a tensioning nut 19 against a valve retaining body 21; a shim 23 is fastened between the flat end faces of the valve body 1 and valve retaining body 21. The valve retaining body 21 has a lateral high-pressure connection 25, which is adjoined by a high-pressure conduit 27 that discharges into the pressure chamber and to which an injection line, leading away from a fuel injection pump not shown, is connected.

The valve member 5 protrudes with its valve member shaft 29 through the shim 23 into a spring chamber 31 in the valve retaining body 21; in the exemplary embodiment, this spring chamber 31 is divided into a lower spring chamber 33, near the combustion chamber, and an upper spring chamber 35, remote from the combustion chamber. The spring chambers 33 and 35 are separated from one another by a connecting wall region in which the lateral high-pressure connection 25 is provided and which is penetrated by the valve member shaft 29.

In the spring chamber 31, two valve springs are provided, axially one behind the other; a first valve spring 37 is inserted into the upper spring chamber 35, and a second valve spring 39 is inserted into the lower spring chamber 33.

The first valve spring 37 constantly urges the valve member 5 in the closing direction, via a collar 41 disposed on the upper end of the valve member shaft 29, and is supported by its other end on the closed end wall of a lid 43 that closes the upper spring chamber 35; between the lid wall and the first spring 37, a first adjusting disk 45 is provided for adjusting the spring prestressing of the first valve spring 37.

Figure 2:
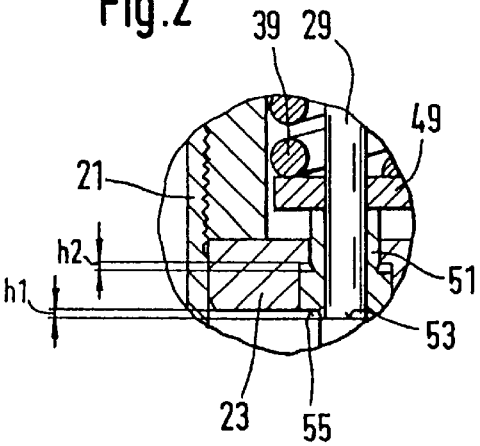
FIG. 2 shows an enlarged detail of FIG. 1 in the region of the shim.

The second valve spring 39 disposed in the lower spring chamber 33 is supported by its upper end, remote from the combustion chamber, on the housing wall toward the connecting wall; once again, a second adjusting disk 47 is placed in between. By its lower end, near the combustion chamber, the second valve spring 39, as shown enlarged in FIG. 2, rests via a spring plate 49 on a stepped-diameter bush 51, whose annular shoulder cooperates with a bore shoulder of the shim 23 and thus defines a stroke h2 at which the second valve spring 39 is operative. The bush 51 is kept by the second valve spring 39 in contact with the upper end face of the valve body 1, and in this position it is spaced apart at its annular shoulder from the bore shoulder in the shim 23 by a distance equivalent to the stroke h2.

When the injection valve is closed, or in other words when the valve member 5 is resting on the valve seat face 9, a gap is provided between an annular end face 53 of the valve member 5 and the lower end face 55 of the bush 51; this gap is equivalent to a valve member prestroke travel h1 in the opening direction, in which only the first valve spring 37 acts upon the valve member 5. The second valve spring 39 does not become operative until after the stroke h1 has been executed and the valve member shoulder 53 contacts the bush 51, and thus the opening stroke motion of the valve member is divided into two stroke phases, separated from one another by a brief pause.

The lid 43 that closes the upper spring chamber 35 is caplike and has a cross-sectional enlargement in the direction of its open face end, and thus an annular end face 58 is formed, with which it rests on the upper end face 60 of the valve retaining body 21; a sealing ring 62 is axially fastened between the annular end face 58 of the lid 43 and the valve retaining body end face 60 and is advantageously guided in an axial annular groove in the valve retaining body end face 60.

The lid 43, with its annular inner wall surface, fits over the upper circumferential wall surface of the valve retaining body 21 and has an annular bead 64, whose transition to the circumferential wall is chamfered, on its outer jacket face on the open end of the lid 43. On the outer circumferential wall of the valve retaining body 21, an annular groove 66 is provided at the level of the open end of the lid.

In a first operation, the lid 43 is now placed on the valve retaining body 21, and in a second operation it is crimped with its open wall region into the annular groove 66 of the valve retaining body 21, producing a stable axial securing of the lid 43 on the valve retaining body 21.

For the crimping operation, a drawing ring 68 is slipped over the lid 43; its inside diameter is stepped, with the larger inside diameter 74 corresponding to the outer diameter of the annular bead 64 and the lid 43 and being provided on the lower region, toward the lid. The smaller inside diameter 76 is the size of the outer diameter of the lid 43 preceding the bead 64 and is provided on the upper end of the drawing ring 68. While the drawing ring 68 is being slipped over the lid 43, the drawing ring, with a shoulder 70 formed on the inside diameter transition, engages the annular bead 64 of the lid 43 and presses it with the free wall end into the annular groove 66 of the valve retaining body 21. The valve retaining body is supported in this process by an annular shoulder 72, provided on its circumferential face, on an abutment. After the crimping operation, the drawing ring 68 is pulled upward and off again, and the cross-sectional transition at the shoulder 70 of the drawing ring 68 is preferably chamfered.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, comprising a valve member (5) guided axially displaceably in a bore (3) of a valve body (1), a valve sealing face disposed on an end of said valve member toward the combustion chamber a fuel injection cross section in an end of said valve body, said valve sealing face (7) of the valve member (5) cooperates with a valve seat face (9) on the valve body (1) to control said fuel injection cross section, a first valve spring (37) that acts upon the valve member (5) is inserted into a first spring chamber (35) provided in a valve retaining body (21), said valve retaining body is braced axially against the valve body (1), said first spring chamber is closed on an end remote from the combustion chamber by a lid (43), and the lid (43) is secured to the valve retaining body (21) by means of a crimped connection.

2. A fuel injection valve in accordance with claim 1, in which a sealing ring (62) is fastened in place between the lid (43) and the valve retaining body (21) that has the first spring chamber (35).

3. A fuel injection valve in accordance with claim 1, in which the lid (43) is embodied as caplike and with an inner circumferential face surrounds an upper end of the cylindrical valve retaining body (21) remote from the combustion chamber, and an annular bead (64) is provided on an open end of the lid (43), on an outer jacket face of the lid (43).

4. A fuel injection valve in accordance with claim 3, in which an annular groove (66) is provided on the valve retaining body (21), at a level of an open end of the lid (43), into which groove the lid (43) is crimped with an open wall region.

5. A fuel injection valve in accordance with claim 3, in which a transition between the circumferential wall of the lid (43) and the annular bead (64) is chamfered on an open end wall region.

6. A fuel injection valve in accordance with claim 1, in which an annular shoulder (72) is provided on an outer circumferential wall face of the valve retaining body (21), and the valve retaining body (21) rests on an abutment as the lid (43) is crimped thereon.

7. A fuel injection valve in accordance with claim 1, in which a second valve spring (39) is provided in a second spring chamber (33), said first valve spring (37) in said first spring chamber rests constantly on the valve member (5), and said second valve spring (39) engages a bush (51) which includes an end face (55) which engages a shoulder (53) of the valve member (5) after an execution of a certain opening stroke motion of the valve member (5) toward said second valve spring (39).

* * * * *